US009322160B2

(12) United States Patent
Iseli

(10) Patent No.: US 9,322,160 B2
(45) Date of Patent: Apr. 26, 2016

(54) METHOD AND DEVICE FOR MANUFACTURING ULTRALIGHT CARDBOARD STRUCTURES HAVING SUBSTANTIAL MECHANICAL STABILITY

(71) Applicant: Alfred Iseli, Uttwil (CH)

(72) Inventor: Alfred Iseli, Uttwil (CH)

( * ) Notice: Subject to any disclaimer, the term of this patent is extended or adjusted under 35 U.S.C. 154(b) by 0 days.

(21) Appl. No.: 14/354,621

(22) PCT Filed: Oct. 29, 2012

(86) PCT No.: PCT/IB2012/002173

§ 371 (c)(1),
(2) Date: Apr. 28, 2014

(87) PCT Pub. No.: WO2013/061151

PCT Pub. Date: May 2, 2013

(65) Prior Publication Data

US 2014/0237940 A1 Aug. 28, 2014

Related U.S. Application Data

(60) Provisional application No. 61/552,496, filed on Oct. 28, 2011.

(51) Int. Cl.
*E04C 2/32* (2006.01)
*E04B 1/343* (2006.01)
(Continued)

(52) U.S. Cl.
CPC ..... *E04B 1/34321* (2013.01); *B31D 3/005* (2013.01); *B31D 3/0269* (2013.01); *E04B 1/34384* (2013.01); *E04C 2/16* (2013.01); *E04C 2/288* (2013.01); *E04C 2/365* (2013.01); *E04C 2/38* (2013.01); *Y10T 156/1084* (2015.01); *Y10T 156/12* (2015.01); *Y10T 428/24165* (2015.01); *Y10T 428/24851* (2015.01)

(58) Field of Classification Search
CPC ..... E04C 2/365; A47K 3/002; Y10T 156/12
USPC ..... 52/783.11, 794.1, 588.1, 145
See application file for complete search history.

(56) References Cited

U.S. PATENT DOCUMENTS 4,155,211 A * 5/1979 Saylor et al. ..... 52/794.1
6,179,086 B1 * 1/2001 Bansemir et al. ..... 181/292
(Continued)

FOREIGN PATENT DOCUMENTS

DE 355 056 6/1922
DE 41 40 053 6/1992
(Continued)

OTHER PUBLICATIONS

International Search Report, International patent apllication No. PCT/IB2012/002173, May 2, 2013.

*Primary Examiner* — Basil Katcheves
(74) *Attorney, Agent, or Firm* — Da Vinci Partners LLC; John Moetteli

(57) ABSTRACT

A process of manufacturing a cardboard building construction material, said cardboard building construction material comprising a plurality of glued cardboard plies, wherein the cardboard plies are rolled on a drum (122) into a roll (114) and wherein glue (134) is circumferentially applied in spaced apart strips (238) thereby defining a non-glued region between the strips, in which region a cutter (246) cuts the cardboard plies from an outer diameter toward an inner diameter of the roll (114).

19 Claims, 4 Drawing Sheets

(51) Int. Cl.

| | |
|---|---|
| ***B31D 3/00*** | (2006.01) |
| ***B31D 3/02*** | (2006.01) |
| ***E04C 2/36*** | (2006.01) |
| ***E04C 2/16*** | (2006.01) |
| ***E04C 2/288*** | (2006.01) |
| ***E04C 2/38*** | (2006.01) |

(56) References Cited

U.S. PATENT DOCUMENTS

| | | | | |
|---|---|---|---|---|
| 6,256,959 | B1 * | 7/2001 | Palmersten | 52/588.1 |
| 6,651,537 | B1 * | 11/2003 | Pfeiffer | 83/436.75 |
| 8,793,821 | B2 * | 8/2014 | Fowkes et al. | 4/579 |

FOREIGN PATENT DOCUMENTS

| | | | |
|---|---|---|---|
| DE | 10305747 | | 8/2004 |
| DE | 10305747 | A1 * | 8/2004 |
| EP | 0 068 873 | | 1/1983 |
| FR | 1 279 466 | | 12/1961 |
| FR | 2 628 135 | | 9/1989 |
| GB | 2 341 619 | | 3/2000 |
| WO | WO 95/14670 | | 6/1995 |

* cited by examiner

METHOD AND DEVICE FOR MANUFACTURING ULTRALIGHT CARDBOARD STRUCTURES HAVING SUBSTANTIAL MECHANICAL STABILITY

CROSS REFERENCE TO RELATED APPLICATIONS

This application is the National Stage of International Application No. PCT/IB2012/002173, filed Oct. 29, 2012, which claims benefit under 35 USC §119(a), to U.S. Provisional Application No. 61/552,496, filed Oct. 28, 2011.

FIELD OF THE INVENTION

The invention relates to a method and a device for the industrial manufacture of ultralight cardboard structures having sufficient mechanical stability for construction generally, and in particular, residential and modular construction.

BACKGROUND OF THE INVENTION

Blocks of glued corrugated cardboard result in plate-like honeycombs having excellent mechanical stability when they are sawed perpendicular to the longitudinal direction of corrugation. Such honeycombs have been used, for example, for producing cardboard pallets of standard dimensions which are mechanically stable, but which weigh much less than conventional wooden pallets (see, for example, International Patent application WO 93/16927 to Iseli).

The mechanical stability of such cardboard structures allows them to be used even in residential construction when the paper base is made fire- and waterproof by appropriate coating (see, for example, DE 196 54 672 by Iseli).

One option for manufacturing honeycombs made of corrugated cardboard is to cut continuously produced one-sided corrugated cardboard into individual sheets having identical longitudinal directions of corrugation, and to glue same into blocks 1.20 to 1.50 m in size. After a certain drying time, the individual conventional honeycombs result from sawing the blocks perpendicular to the longitudinal direction of corrugation, using a large band saw. This process results in very high cutting losses of at least 20%, which in addition occur almost exclusively from difficult-to-control paper dust. Furthermore, after sawing, the conventional honeycombs must be sized by grinding, and the scrap rate is high due to inadequate control of the gluing in the blocks.

DE 103 05 747 describes a method which ensures much more uniform gluing and lower cutting losses, and which makes subsequent grinding unnecessary. This is achieved by rolling up and rewinding, while simultaneously carrying out the gluing process and cutting to size with the aid of razor blades, before the one-sided corrugated cardboard is wound onto a hollow roll. Another advantage of this method is that the honeycombs no longer have to be sized, since they may be cut to within an accuracy of one-tenth millimeter by the razor blades. Cutting with the razor blades also prevents the corrugated cardboard from being crushed, which occurs with the blades that are typically used. Namely, when such blades are used, the corrugation is pressed onto the backing paper, which may cause the honeycombs to be practically closed during cutting.

However, integrating the gluing and cutting device described in DE 103 05 747 into an industrial facility for manufacturing corrugated cardboard has proven to be difficult, and there are numerous drawbacks to these conventional honeycomb manufacturing processes. Namely, if cutting is carried out first, followed by gluing, there is a risk of uncontrolled subsequent gluing of strips, which have already been cut, during the rolling to form wheel-shaped honeycombs. On the other hand, if gluing is carried out first, followed by cutting, replacing the razor blades which are contaminated with glue requires frequent stoppages of the entire facility, which for a typical running speed of the corrugated cardboard of 150-400 m/min and a width of 1.25 to 2.50 m has proven to be extremely disadvantageous.

The present invention improves the production suitability of a gluing and cutting device and station for manufacturing non-conventional honeycombs, so that the honeycombs may be easily integrated into a facility for manufacturing corrugated cardboard which is operated at a customary speed.

SUMMARY OF THE INVENTION

The invention relates to a method and a device for the industrial manufacture of lightweight honeycombs made of corrugated cardboard having substantial mechanical stability and load bearing capacity, integrated into a production facility for manufacturing corrugated cardboard. Cutting losses and paper dust are minimized.

In one variant, the invention provides an improved process of manufacturing a cardboard building construction material having an exterior surface with at least 5 sides. The cardboard building construction material has a plurality of glued cardboard plies, a plurality of optional innermost cardboard plies, and a plurality of outermost cardboard plies. The innermost and outermost cardboard plies are substantially free of glue or cuts. The process includes simultaneously cutting through the plurality of glued cardboard plies and the plurality of outermost cardboard plies to create at least 5 sides so that the cardboard building construction material has substantially identical rigidity along a longitudinal and a transverse axis of the building construction material.

In another variant, the invention provides a cardboard structure that has a plurality of cardboard honeycombs, or portions thereof, arranged in rows, in which at least three sides of one of the honeycombs, or portions of the sides, are glued to one or more of the adjacent honeycombs.

In yet a further embodiment, the invention provides a building material suitable for construction of an architectural structure that includes a plurality of rows of glued hexagonal honeycombs, or portions thereof. The building material is suitable to construct a building that has a plurality of rows of glued hexagonal honeycombs, or portions thereof.

In yet another variant, a method of constructing a prefabricated building is provided that includes connecting a plurality of modular units. The modular units each include a plurality of rows of glued semi-hexagonal and/or hexagonal honeycombs, or portions thereof.

In yet another aspect, the invention provides a production facility for manufacturing building components or portions thereof. The facility includes a station configured to create one or more of a plurality of semi-hexagonal honeycombs and/or hexagonal honeycombs, and can include optional stations for adding other components to the honeycombs.

The subject matter of the invention will be explained in more detail in the following text with reference to exemplary embodiments which are illustrated in the attached drawings.

DETAILED DESCRIPTION OF EXEMPLARY EMBODIMENTS

The present invention provides lightweight, high strength, high rigidity, highly mechanically stable, and economical building components and modular units which can be assembled manually without the use of cranes or other heavy construction equipment. The lightweight, high strength environmentally-designed modules and components thereof (including honeycombs (420, 430, and assemblies thereof) have a high R-value and are able to bear significant structural loads, and thus are ideally suited for prefab construction. The components or modules of the present invention are used for ceilings, outside and inside walls and roofs in construction applications.

The present invention further provides a process, device, and production facility station for manufacturing a building material, and components thereof composed of "honeybomb" elements. As used herein, the term "honeycomb" means a structure created by the processes described in this specification, and within variants of embodiments of the present invention within the scope of the appended claims. It is appreciated that the "honeycomb" structure (420) described herein provides comparable mechanical stability both in the longitudinal and transverse direction of the honeycomb. The mechanical stability of the present invention makes it suitable for construction of buildings, e.g. residential housing and pre-fabricated structures.

Figure 1A:
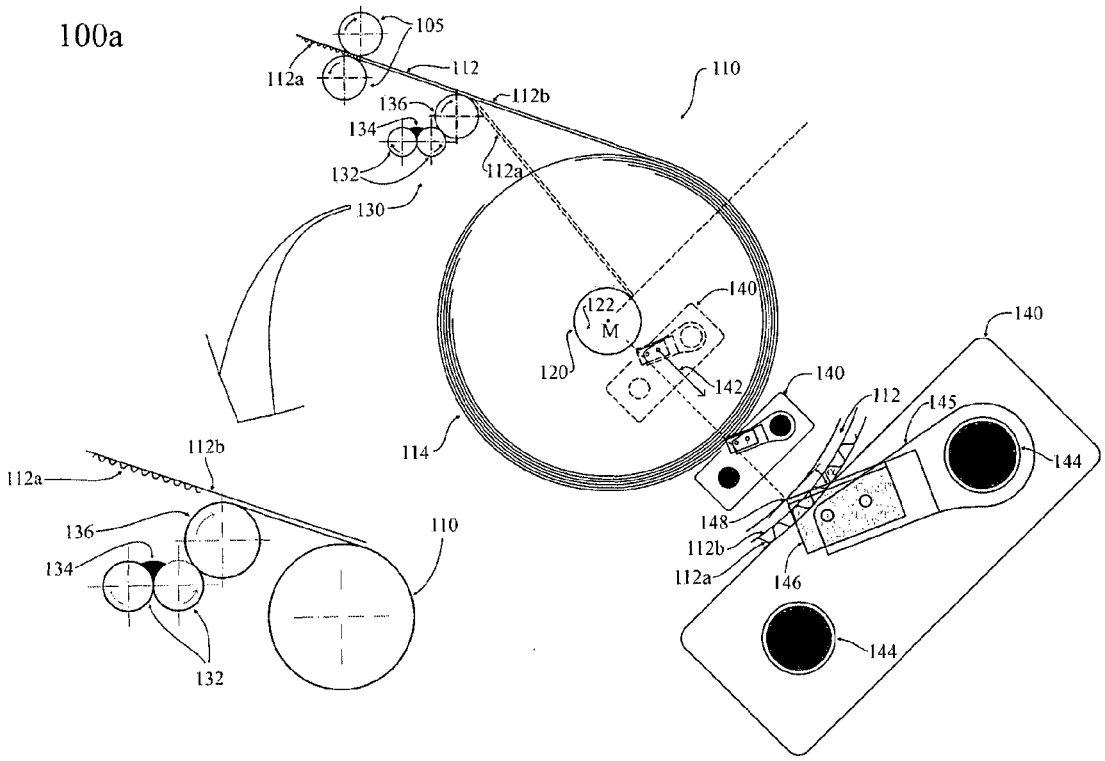
FIGS. 1*a*, 1*b* show schematic longitudinal sections of the roll-up, gluing, and cutting device of a facility for producing honeycombs from corrugated cardboard, having a gluing and cutting station.
Figure 1B:
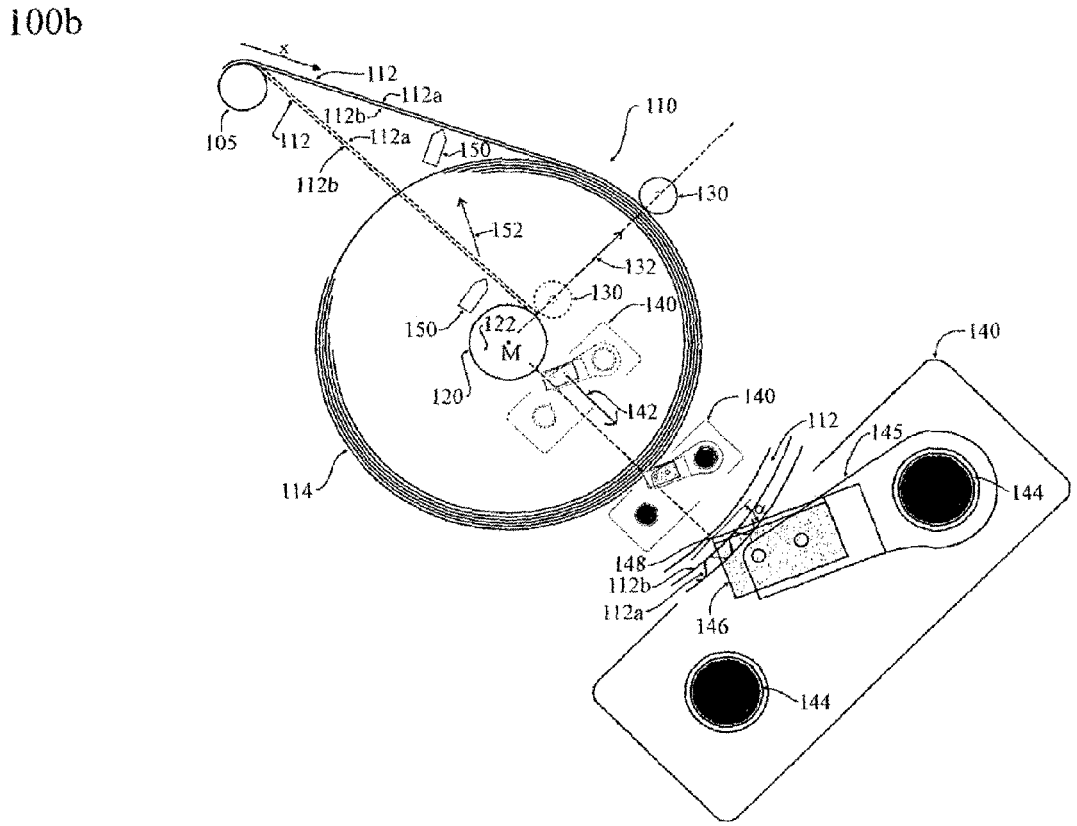

An example of device and process is provided in FIG. 1. According to the longitudinal sections 100*a*, 100*b* in FIG. 1*a*, 1*b*, respectively, a one-sided corrugated cardboard 112 composed of a corrugation 112*a* and a backing paper 112*b* is guided directly by an industrial unit, not illustrated (speed 150-400 m/min, width 1.25-3.60 m) over an accumulator belt and rollers 105 to a conventional roll-up device 110, and is wound onto the drum 120 thereof. The diameter of the drum 120 is advantageously selected to be as small as possible in order to keep the central holes 316 in the completed honeycomb rolls 310 (FIG. 3) correspondingly small. The roll-up device 110 forms an integrated unit with the gluing station 130, 150 and cutting station 140 according to the invention. Depending on the type of attachment of the first corrugated cardboard ply 112 to the drum 120, preferably either the corrugation 112*a* or the backing paper 112*b* is oriented toward the drum side. The first ply 112 may be attached to the drum 120, for example, by either adhering or clamping. In the preferred embodiment in FIG. 1*a*, the corrugation 112*a* is oriented toward the drum. The razor blade cut (see below) is thus made from the side of the backing paper 112*b*, which simplifies the cutting process.

A second example is illustrated in FIG. 1*b*. It is particularly advantageous for the first ply 112 to be attached to the drum 120 very quickly by a vacuum. A vacuum is then maintained in the interior 122 of the hollow drum 120, by means of which the backing paper 112*b* of the first ply of the corrugated cardboard may be suctioned. The roll-up process is started by the suctioning of the corrugated cardboard.

In both examples, there is no gluing or cutting during the first three to five revolutions of the drum 120. It is appreciated that more or fewer revolutions of the drum 120 are also contemplated depending on the material used. After this point, the gluing and cutting operation begins, until the resulting corrugated cardboard roll 114 has reached a diameter of approximately 1.35-1.80 m. The last three to five plies (or other suitable ply number) are once again neither glued nor cut. As a result, in one variant of the invention the wheel-shaped honeycombs are held together when the roll 114 is removed from the roll-up station 110. At the end of the winding-up process, the corrugated cardboard 112 is cut through and supplied directly to a second roll-up device, whereupon the roll-up, gluing, and cutting process begins anew.

The completed corrugated cardboard roll 114, composed of glued and cut honeycomb wheels which are held together by the unglued, uncut innermost and outermost corrugated cardboard plies 112, may now be stripped from the drum 120 and delivered for further processing, whereby the transport has a very simple design because of the compact configuration.

Figure 2:
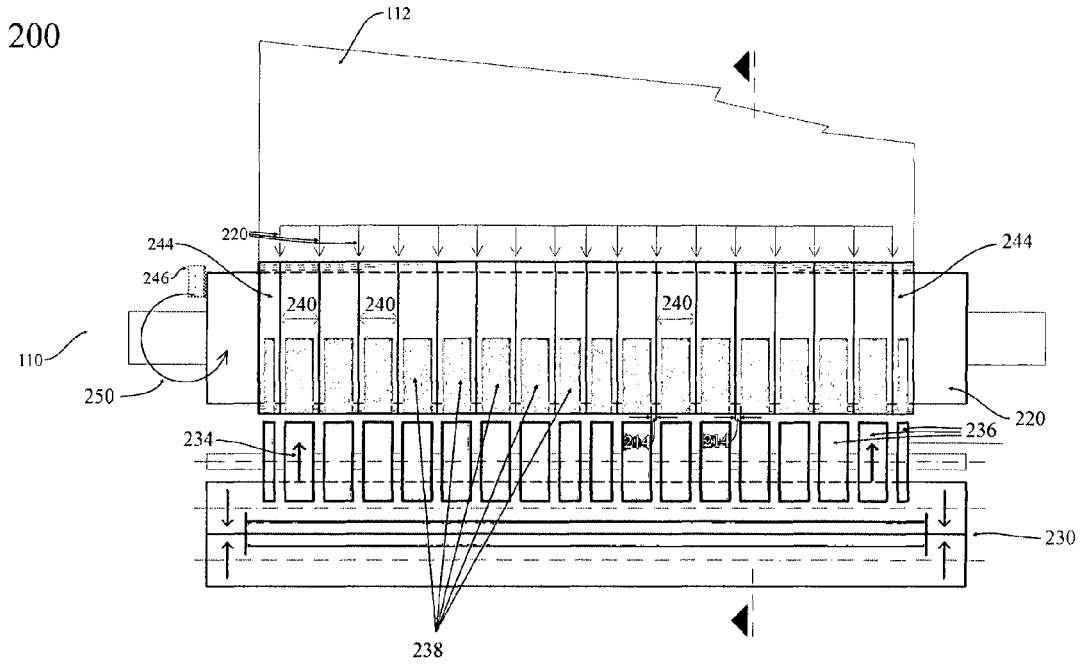
FIG. 2 shows a schematic top view of the roll-up device, together with cutting points and glue application.

In another embodiment, the roll 114 is stripped from the drum 120, and the innermost and outermost corrugated cardboard plies are automatically cut through by blades 246 mounted at the ends of the drum (FIG. 2). The individual wheel-shaped honeycombs are thus free and may likewise be further processed, in the present case, advantageously directly in the production unit for the manufacture of corrugated cardboard.

One variant, of the gluing and cutting device according to the invention which is integrated into the roll-up station 110 is described below with reference to the longitudinal section 100*a* in FIG. 1*a*. In a process of manufacturing a cardboard building construction material, the cardboard building construction material has a plurality of glued cardboard plies. The cardboard plies are rolled on a drum 122 into a roll 114. Glue 134 is circumferentially applied in spaced apart radial strips 238 thereby defining a non-glued region between the strips. A cutter 246 cuts the cardboard plies from an outer diameter toward an inner diameter of the roll 114, thus avoiding fouling of the cutter 246 with glue and permitting simultaneous cutting of the roll 114 as the roll is formed.

The gluing station 130 is situated upstream from the cutting station 140, and is composed of a gluing unit 132 for uniformly distributing the glue 134 on glue rollers 136 whose thickness and distance from one another is determined by the desired strip-shaped glue application 238 (see the top view in FIG. 2). In this exemplary embodiment, the glue is applied to the inwardly facing corrugated surface 112*a* of the corrugated cardboard. This has the advantage that only the corrugation crests are contacted with glue, and a subsequent coating adheres well to the surfaces not contacted with glue. The embodiment shown in FIG. 1*a*, having the gluing station 130 situated upstream from the roll-up station 110, has the further advantage that the gluing station may be operated stationarily; i.e., the roll 114 does not have to be tracked, e.g. is tracking free.

In other embodiments, as shown in FIG. 1*b*, in which the gluing station 130 is located directly on the roll-up station 110, the gluing station is guided outwardly in the radial direction 132 during the roll-up process to ensure a constant pressure on the roll 114. If the corrugation side 112*a* faces outwardly in this embodiment, with the cutting station 140 situated downstream the razor blade cut is necessarily made on this corrugated side, which can adversely affect the stress on the razor blades.

In another embodiment, the glue is applied by nozzles 150, but preferably on the backing paper 112*b* of the corrugated cardboard. The nozzles are likewise continuously guided outwardly in the radial direction 152 under a constant counter pressure on the corrugated cardboard. The gluing assembly composed of nozzles, as indicated in FIG. 1*b*, may be situated upstream from the roll-up station 110, or may be situated directly on the roll-up station instead of the glue rollers 236. For a gluing unit equipped with rollers 236, the drum 220 and the glue rollers 236 move in opposite directions 250 and 234, as shown in FIG. 2. In any case, the contacting of the backing paper 112*b* with glue has the disadvantage that a subsequent coating of the honeycombs may possibly not gain a hold at the sites 238 contacted with glue.

For glue application by rollers 236 as well as by nozzles 150, the glue is applied not approximately over the entire surface, but, rather, in the form of strips 238 (FIG. 2). These strips 238 have a safety clearance 214 from the cutting points 220 to prevent gluing of the cuts during roll-up, and for an upstream gluing station, to prevent contamination of the razor blades 146.

The cutting station 140 is located directly on the roll-up station 110, and during the roll-up process likewise moves outwardly in the radial direction 142, once again a constant pressure being exerted on the corrugated cardboard roll so that the individual plies lie fully flat. The holders 145 for the razor blades 146 may be fixed to crossbars 144, for example. The distance between the blades is selected according to the desired honeycomb thickness 230, whereby not all of these honeycomb thicknesses 230 necessarily have to be the same size. In one embodiment, however, the honeycomb thicknesses 230 are selected to be identical, since the completed honeycombs would otherwise have to be sorted for further processing. As mentioned above, in any case it must be ensured that the individual honeycomb thicknesses 240 correspond to the widths of the glue strips 238 to ensure sufficiently large distances 214 between the cutting points 220 and the glue strips 238. Otherwise, the already cut honeycombs could become re-glued. During the cutting, at least one entire ply 112 of the corrugated cardboard is severed. However, the tip 148 of the razor blade advantageously only reaches a depth of approximately one and one-half plies 112. In other respects, it has proven advantageous to keep the setting angle $\alpha$ of the razor blades 146 small so that the corrugated cardboard is practically pulled over the cutting surface during the cutting operation.

In another embodiment, for example two sets of razor blades are fixed on different crossbars 144 in such a way that in each case a blade from the first set cuts one side of a honeycomb, and the corresponding blade from the second set cuts the other side. If one of the blade sets is now mounted in such a way that a motion in the direction of the drum axis M is made possible, three-dimensional honeycombs, i.e., honeycombs having a corrugated surface, may be produced. In this embodiment, however, in addition to the lateral cut 244 a further cut is necessarily made, and the razor blades are subjected to significantly higher stress than for straight cuts.

Figure 3A:
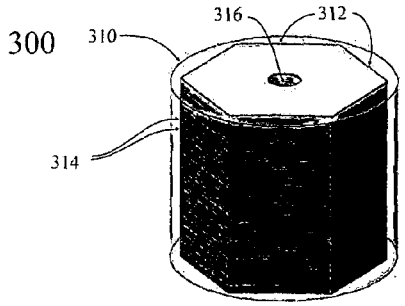
FIGS. 3*a* through 3*c* show the production of hexagonal honeycombs from circular honeycomb rolls.
Figure 3B:
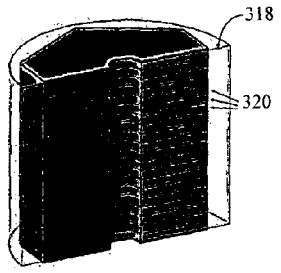
Figure 3C:
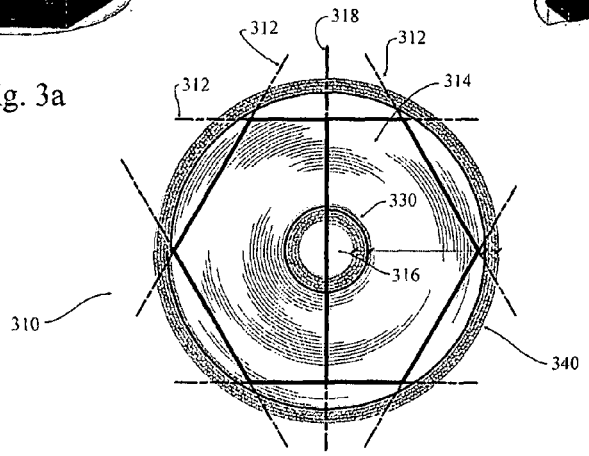

With reference to the perspective views in FIGS. 3*a* and 3*b* as well as the top view in FIG. 3*c*, one further processing operation of honeycomb wheel rolls 114, 310 is described below; the honeycombs of the honeycomb wheel rolls are momentarily held together by the innermost and outermost three to five corrugated cardboard plies 330, 340 which are uncut during the roll-up process. According to the manufacturing process, these completed honeycombs are present in the form of wheels whose size corresponds to the diameter of the competed corrugated cardboard roll 114, and which contain a central hole 316, having the diameter of the drum 120, which is kept as small as possible by suitable selection of the drum. In one variant, the cylindrical honeycomb wheel roll 114, 310 is brought into a hexagonal shape by saw cuts 312 parallel to its longitudinal axis. According to FIG. 3*c*, the outermost corrugated cardboard plies 340 are thus likewise severed. If the innermost plies 330 are also cut through, the honeycomb roll disaggregates into individual hexagonal honeycombs 314, which may be further processed.

Figure 4:
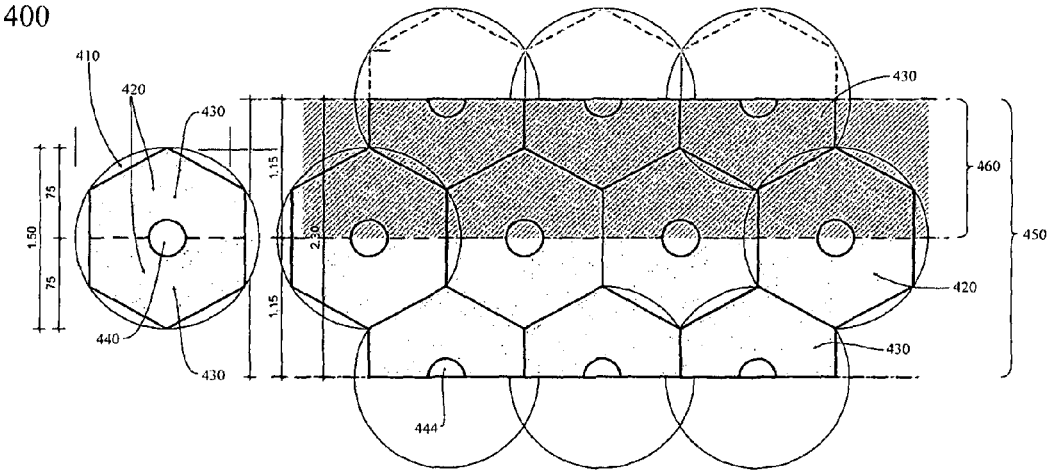
FIG. 4 shows honeycomb mats produced from whole and halved hexagonal honeycombs.

The described roll-up process has the major advantage that these honeycombs have identical rigidity and/or mechanical stability in any direction (e.g. both longitudinal and transverse directions), in contrast to honeycombs made of block material which have different values in the longitudinal and transverse directions. Honeycombs in the shape of hexagons 314, for example, are therefore ideally suited as composite material. As shown in FIG. 4, it is particularly advantageous to combine hexagons with half-hexagons. Honeycombs in the form of half-hexagons are fabricated particularly easily from the honeycomb rolls 114, 310, since the inner corrugated cardboard plies 340 are likewise severed by an additional cut 318 when the hexagonal honeycombs are cut in half.

FIG. 4 shows variants of large-surface honeycomb mats or components of building materials. The mats and/or building material components are produced, for example, from a central row of hexagonal glued honeycombs 420, and are bordered by two rows of half-hexagonal honeycombs 430. For a diameter of the uncut honeycomb wheel roll 410 of 1.50 m, the resulting honeycomb mat 450 has a width of 2.30 m. If only two half-hexagons 430 are glued in each case to form a honeycomb mat 460, this mat therefore has a width of 1.15 m. If desired, the central hole 440 in the hexagonal honeycombs or the half-holes 444 in the cut hexagonal honeycombs are optionally closed by a suitable filler material.

Instead of defining the final shape of the honeycombs by sawing, the shape of the honeycomb roll may also be modified during the roll-up process. This may be carried out, for example, by briefly stopping the roll-up process after a few revolutions in order to glue corrugated cardboard strips parallel to the longitudinal axis M of the drum 120. Using six strips at an angular distance of 60 degrees, a completed corrugated cardboard roll 114 having an essentially hexagonal cross section may be produced in this way. Changes in shape are also possible in that, instead of paper strips, after several revolutions metal profiles are inserted parallel to the drum axis 120. However, this variant of the invention may have slightly lower mechanical stability due to additional cavities in the completed honeycombs.

As illustrated in the FIGS. 1*a*, 1*b* and 2, the invention provides an improved process. In the process of manufacturing a cardboard building construction material having an exterior surface with at least 5 sides (FIGS. 3*a*, 3*b*, 3*c* and 4), the cardboard building construction material includes a plurality of glued cardboard plies, a plurality of optional innermost cardboard plies 330, and a plurality of outermost cardboard plies 340. The innermost and outermost cardboard plies are substantially free of glue connecting the innermost and outermost cardboard plies as shown in FIG. 3*c*. The improvement includes simultaneously cutting through the plurality of glued cardboard plies and the plurality of outermost cardboard plies to create at least 5 sides of the cardboard building construction material (FIGS. 3*b*, 3*c* and 4), so that the cardboard building construction material has substantially identical rigidity along a longitudinal and a transverse axis of the building construction material. Optionally, the processing includes removing the innermost cardboard plies 330 (FIG. 3*c*).

In another variant and as Illustrated in FIG. 4, a cardboard structure includes a plurality of cardboard honeycombs. Each of the honeycombs include six honeycomb sides (FIGS. 3*a* and 4), or portions thereto (FIGS. 3*b* and 4), arranged in rows. It is apparent that at least three honeycomb sides of one of the honeycombs, or portions of the sides, are glued to another honeycomb at the honeycomb sides of the another honeycomb, or portions thereof in this embodiment. The rows can include on row of half-hexagonal honeycombs 430 glued directly to another row of half-hexagonal honeycombs (not shown) as described herein. In another variant, a row of half-hexagonal honeycombs are glued to hexagonal honeycombs 420. It is appreciated that various combinations can be made to obtain the desired cross-sectional thicknesses and resulting mechanical support ability. The cardboard honeycombs are constructed to have similar rigidity along a longitudinal and a transverse axis of each the cardboard honeycomb. As such, the cardboard honeycombs are made from recycled paper in one variant of the invention. Given the significant mechanical stability of the honeycombs in relation to their weight, the building material is suitable for construction of an architectural structure. Various other materials can be connected or glued to the structures illustrated in FIG. 4. By way of example, a board is connected to the rows using adhesive or mechanical connectors such as screws or staples. Exemplary boards include plasterboard, a cement board, a fiber board, a particle board, a natural construction material such as lumber, artificial stone material, natural stone material, and the like. Given the utility of components of the invention in construction, in another variant, a building comprising a plurality of rows of glued hexagonal honeycombs 420, or portions thereof 430 is also provided. These buildings include homes, barns, sheds, utility sheds, modular housing units, pre-fabricated buildings, and disaster relief buildings.

In another variant, a method of constructing a pre-fabricated building is provided herein. The method includes connecting a plurality of modular units, wherein each the modular units has a plurality of rows of glued hexagonal honeycombs 420, or portions thereof 430. Each modular unit can include doors, windows, roofing material, and other customary features for modular units. Connecting includes assembling the modular units utilizing a tongue and groove assembly, and optionally gluing the modular units together. The modular housing units which can be constructed for less than to about half the cost of traditional housing methods. In one variant, the honeycombs 420, 430 are constructed from recycled paper. Mineral coatings along with other coatings are applied to make the honeycomb structure, and/or exterior thereof to provide a fire resistant honeycomb structure, a water resistant honeycomb structure, and/or a vermin resistant honeycomb structure. It is appreciated that modular building components utilize the honeycombs 420, 430 and mats 450 of the present invention.

In yet a further aspect, the invention provides a production facility for manufacturing building components or parts therefor. The building facility includes a station (FIGS. 1*a*, 1*b* and 2) configured to create one or more of a plurality of semi-hexagonal honeycombs 430 or hexagonal honeycombs 420. An optional gluing station is provided to glue one or more of the hexagonal honeycombs 420 to each other, or to one or more of the semi-hexagonal honeycombs 430. As has been described herein, the station and the process steps which the station executes a plurality of honeycombs, each of the honeycomb having substantially similar mechanical stability along a longitudinal and a transverse axis of the honeycomb.

In another variant of the invention, one or more fiberboard, cement board, plasterboard, and/or particleboard elements are connected to the mats 450 of the present invention (not pictured) utilizing standard mechanical connecting elements (e.g. screws, fasteners) or adhesives. In another variant, other veneers such as wood veneers, natural stone, or artificial stone veneers, stucco, Styrofoam, or other materials are applied to at least one surface of the mats described below, or both surfaces, e.g. inside wall and outside wall facing surfaces. As is appreciated, the mats 450 of the present invention are used as load bearing walls, sub-floors, ceilings, roofs, and in other standard sections of buildings. The components or modules, in one variant of the invention, weigh a maximum of 60 kg, and are assembled using a tongue and groove system and then glued together. The components are installed directly on a foundation slab, on basement walls or as additions to existing structures.

One of skill in the art will also recognize that the functional building blocks, and other illustrative blocks, modules and components herein, can be implemented as illustrated or by discrete components, or any combination thereof. Moreover, although described in detail for purposes of clarity and understanding by way of the aforementioned embodiments, the present invention is not limited to such embodiments. It is apparent to one of average skill in the art that various changes and modifications may be practiced within the spirit and scope of the invention, as limited only by the scope of the appended claims.

I claim:

1. A process of manufacturing a cardboard building construction material, said process comprising providing said cardboard building construction material comprising a plurality of glued cardboard plies, wherein, the cardboard plies are rolled on a drum into a roll and wherein glue is circumferentially applied, and a cutter cuts the cardboard plies along cutting points from an outer diameter toward an inner diameter of the roll, thus permitting simultaneous cutting of the roll as the roll is formed, wherein further the glue is applied in strips such that no adhesive is applied in gaps a clearance from and on both sides of the cutting points thereby defining non-glued regions adjacent the cutting points between the strips so as to avoid fouling of the cutter with glue.

2. The process of claim 1, wherein the roll is comprised of a plurality of optional innermost cardboard plies, and a plurality of outermost cardboard plies, said innermost and outermost cardboard plies being substantially free of glue, an improvement comprising cutting through said plurality of glued cardboard plies and said plurality of outermost cardboard plies to create an at least 5 sided cardboard building construction material, whereby said cardboard building construction material has comparable rigidity along a longitudinal and a transverse axis of said building construction material.

3. The process of claim 1 further comprising removing said innermost cardboard plies.

4. A building material of cardboard building construction manufactured utilizing the process of claim 1, the building material compromising a plurality of glued cardboard plies, wherein, the cardboard plies are rolled into a roll wherein glue is circumferentially applied, and the cardboard plies are cut along cutting points from an outer diameter toward an inner diameter of the roll, wherein further the glue is applied in strips such that no adhesive is applied in gaps a clearance from and on both sides of the cutting points thereby defining non-glued regions adjacent the cutting points so as to avoid fouling of the cutter with glue.

5. The building material of claim 4 comprising a plurality of cardboard honeycombs, each of said honeycombs comprising six honeycomb sides, or portions thereof, arranged in rows, in which at least three honeycomb sides of one of said honeycombs, or portions of said sides, are glued to another honeycomb at the honeycomb sides of said another honeycomb, or portions thereof.

6. The building material of claim 5 in which said rows comprise half-hexagonal honeycombs.

7. The building material of claim 6 in which said rows further comprise hexagonal honeycombs.

8. The building material of claim 5 in said cardboard honeycombs are constructed to have comparable rigidity along a longitudinal and a transverse axis of each said cardboard honeycomb.

9. The building material of claim 5 in which said cardboard honeycombs comprise recycled paper.

10. A building material made according to the process of claim 1, wherein the building material is suitable for construction of an architectural structure comprising a plurality of rows of glued hexagonal honeycombs, or portions thereof.

11. The building material of claim 10 further comprising a board connected to said rows.

12. The building material of claim 11 in which said board is selected from one of the group consisting of plasterboard, a cement board, a fiber board, and a particle board.

13. The building material of claim 11 in which said board is a natural construction material.

14. A building comprising, a plurality of rows of glued hexagonal honeycombs, or portions thereof made according to the process of claim 1.

15. A method of constructing a pre-fabricated building comprising connecting a plurality of modular units, wherein each said modular unit comprises a plurality of rows of glued hexagonal honeycombs, or portions thereof made according to the process of claim 1.

16. The method of claim 15 in which connecting comprises assembling the modular units utilizing a tongue and groove assembly, and optionally gluing said modular units together.

17. A production facility for manufacturing building components or parts therefor made according to the process of claim 1, comprising a station configured to create one or more of a plurality of support honeycombs, said support honeycombs selected from one of a group consisting of semi-hexagonal honeycombs and hexagonal honeycombs.

18. The production facility of claim 17 further comprising a gluing station to glue one or more of said hexagonal honeycombs to each other, or to one or more of said semi-hexagonal honeycombs.

19. The production facility of claim 17 in which said station creates a plurality of honeycombs, each said honeycomb having substantially similar mechanical stability along a longitudinal and a transverse axis of said honeycomb.

* * * * *